United States Patent [19]

Padron et al.

[11] Patent Number: 4,532,067

[45] Date of Patent: Jul. 30, 1985

[54] LIQUID DETERGENT COMPOSITIONS CONTAINING HYDROXYPROPYL METHYLCELLULOSE

[75] Inventors: Tamara Padron, North Bergen; Ignacio Lopez, Guttenberg, both of N.J.

[73] Assignee: Lever Brothers Company, New York, N.Y.

[21] Appl. No.: 569,802

[22] Filed: Jan. 11, 1984

[51] Int. Cl.[3] ..... C11D 17/00

[52] U.S. Cl. ..... 252/174.17; 252/174.23; 252/559; 252/DIG. 14; 427/393.4

[58] Field of Search ..... 252/174.17, 174.23, 252/559, DIG. 2, DIG. 14; 427/393.4

[56] References Cited

U.S. PATENT DOCUMENTS

| | | | |
|---|---|---|---|
| 2,994,665 | 8/1961 | Reich et al. | 252/137 |
| 3,501,409 | 3/1970 | Matson et al. | 252/137 |
| 3,523,088 | 8/1970 | Dean et al. | 252/174.17 |
| 3,549,542 | 12/1970 | Holderby | 252/137 |
| 3,709,838 | 1/1973 | Mausner et al. | 252/559 |
| 3,803,285 | 4/1974 | Jensen | 252/174.17 |
| 3,869,399 | 3/1975 | Collins | 252/559 |
| 4,000,093 | 12/1976 | Nicol et al. | 252/529 |
| 4,014,808 | 3/1977 | Herpers et al. | 252/174.17 |
| 4,020,015 | 4/1977 | Bevan | 252/174.17 |
| 4,028,262 | 6/1977 | Cheng | 252/559 |
| 4,079,078 | 3/1978 | Collins | 252/559 |
| 4,100,094 | 7/1978 | Burns et al. | 252/89 R |

FOREIGN PATENT DOCUMENTS 1534641 12/1978 United Kingdom .

*Primary Examiner*—Paul Lieberman
*Assistant Examiner*—Willie Thompson
*Attorney, Agent, or Firm*—Milton L. Honig; James J. Farrell

[57] ABSTRACT

An aqueous liquid detergent composition containing a nonionic surfactant, a builder, a particular hydroxypropyl methylcellulose ether and optionally an anionic surfactant is disclosed having unusual stability, especially at low temperatures. The hydroxypropyl methylcellulose is characterized as having 28–30% methoxyl and 7–12% hydroxypropyl substitution with molecular weight from 5–250 cps nominal viscosity in 2% aqueous solution at 68° F.

11 Claims, No Drawings

LIQUID DETERGENT COMPOSITIONS CONTAINING HYDROXYPROPYL METHYLCELLULOSE

BACKGROUND OF THE INVENTION

1. Field of the Invention

The invention relates to liquid detergent formulations containing hydroxypropyl methylcellulose ethers. The compositions exhibit improved stability characteristics, especially during low temperature storage.

2. The Prior Art

Cellulose ethers have long been recognized as thickening, soil-shield and anti-redeposition agents in liquid detergents. Soil-shield is the protective coating of cellulosic deposited onto synthetic fabric during a wash in a detergent containing both a surfactant and a cellulose ether. Removal of oil and grease stains is facilitated in subsequent washes where fabrics have been soil-shield treated. Anti-redeposition agents function to prevent soil from re-settling on fabrics after it has been removed during washing.

Whether used for thickening or laundering purposes, the cellulose polymers frequently become incompatible with the liquid detergent compositions. Solid builders, inorganic salts and various hydrophobic components all contribute to the destabilization of the cellulose polymer in these formulations.

Freeze-thaw and low temperature storage stability is particularly poor with cellulose ethers in built, mixed anionic-nonionic liquid detergents. In cold weather, agglomeration of the cellulose ether occurs with resultant separation from the liquid. Concomitantly, the liquid's viscosity is altered.

It is an object of the present invention to overcome the freeze-thaw and low temperature storage instability of heavy duty liquid detergents containing cellulose ether.

A further object of this invention is to provide a stable heavy duty liquid detergent containing cellulose ether exhibiting soil-shield and anti-redeposition benefits.

SUMMARY OF THE INVENTION

An aqueous liquid detergent composition is provided comprising:

(i) as the only cellulose ether from about 0.1% to about 1.5% hydroxypropyl methylcellulose having from 28 to 30% methoxyl and 7 to 12% hydroxypropyl substitution, the molecular weight ranging from 5 to 250 cps expressed as nominal viscosity of a 2% aqueous solution at 68° F.;

(ii) from about 0.1% to about 15% of a nonionic surfactant;

(iii) from about 5% to about 30% of an anionic surfactant; and (iv) from about 1% to about 30% of a builder.

DETAILED DESCRIPTION OF THE INVENTION

It has been discovered that aqueous built mixed anionic-nonionic detergent formulations containing a highly specific cellulose ether exhibit unusual low temperature freeze-thaw and storage stability. Typical cellulose ether gelation and precipitation problems are not encountered with these compositions.

Critical to the invention is the use, as the only cellulose ether, of a particular hydroxypropyl methylcellulose. This material is characterized by having 28 to 30% methoxyl and 7 to 12% hydroxypropyl substitution. Additionally, its molecular weight must range between 5 and 250 cps, expressed as nominal viscosity of a 2% aqueous solution at 68° F. Within this range of viscosity, the most highly preferred polymer is one with a nominal viscosity between 112 and 168 cps. Molecular weights for the instant polymers may also be expressed in Number Average Molecular Weight which may range from 10,000 to about 32,000. Number Average Degree of Polymerization, $DP_n$, will range from about 142 to 163. Hydroxypropyl methylcellulose as afore described is commercially available from the Dow Chemical Company under the trademark Methocel E.

Cellulose ethers other than the particular hydroxypropyl methyl derivative were conspicuously inferior in performance. Freeze-thaw and low temperature storage stability of methylcellulose, hydroxybutyl methylcellulose, hydroxyethyl methylcellulose and hydroxyethyl cellulose with the instant formulations generated unacceptable stability problems. The latter polymers were obtained commercially from the Dow Chemical Company as Methocel A and Methocel HB, from American Hoechst as Tylose MH, and from Hercules, Inc. as Natrosol, respectively.

A number of variously substituted hydroxypropyl methylcelluloses are commercially available. None other than the particular polymer with aforementioned degrees of substitution and molecular weight were found suitable. For instance, Methocel F, J and K, all sold by the Dow Chemical Company, are inoperative hydroxypropyl methylcelluloses. Methocel F, J and K have methoxyl substitutions of 27–30%, 16.5–20% and 19–25%, respectively. Their hydroxypropyl substitution is 4.0–7.5%, 23–32% and 4–12%, respectively.

Methocel E4M having 28–30% methoxyl and 7–12% hydroxypropyl substitution but of higher molecular weight (3500–5600 cps) also proved unsuitable for preparing stable formulations of the instant invention. Methocel E4M could only be used at very low concentrations. Even then, there was noticeable settling out of the polymer precipitating a rubbery and very elastic substance.

The instant liquid detergent systems are directed at mixed anionic-nonionic surfactant compositions.

Nonionic surfactants can be broadly defined as surface active compounds which do not contain ionic functional groups. An important group of chemicals within this class are those produced by the condensation of alkylene oxide groups (hydrophilic in nature) with an organic hydrophobic compound; the latter is aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Illustrative but not limiting examples of the various chemical types of suitable nonionic surfactants include:

(a) polyoxyethylene or polyoxypropylene condensates of aliphatic carboxylic acids, whether linear- or branched-chain and unsatuated or saturated, containing from about 8 to about 18 carbon atoms in the aliphatic chain and incorporating from 5 to about 50 ethylene oxide or propylene oxide units. Suitable carboxylic acids include "coconut" fatty acids (derived from coconut oil) which contain an average of about 12 carbon atoms, "tallow" fatty acids (derived from tallow-class fats) which contain an average of about 18 carbon atoms, palmitic acid, myristic acid, stearic acid and lauric acid.

(b) polyoxyethylene or polyoxypropylene condensates of aliphatic alcohols, whether linear- or branched-chain and unsaturated or saturated, containing from about 8 to about 24 carbon atoms and incorporating from about 5 to about 50 ethylene oxide or propylene oxide units. Suitable alcohols include the "coconut" fatty alcohol, "tallow" fatty alcohol, lauryl alcohol, myristyl alcohol and oleyl alcohol. Particularly preferred nonionic surfactant compounds in this category are the "Neodol" type products, a registered trademark of the Shell Chemical Company. Neodol 25-9, a $C_{12}$–$C_{15}$ linear primary alcohol ethoxylated with an average of 9 moles ethylene oxide has been found particularly useful.

(c) polyoxyethylene or polyoxypropylene condensates of alkyl phenols, whether linear- or branched-chain and unsaturated or saturated, containing from about 6 to about 12 carbon atoms and incorporating from about 5 to about 25 moles of ethylene oxide or propylene oxide.

Appropriate concentrations for the nonionic surfactant range from about 0.1% to about 15% by weight of the total formulation. Preferably, the concentrations range from about 2% to about 10%.

A wide variety of anionic surfactants may be utilized. Anionic surfactants can be broadly described as surface active compounds with negatively charged functional group(s). An important class within this category are the water-soluble salts, particularly alkali metal salts, of organic sulfur reaction products. In their molecular structure is an alkyl radical containing from about 8 to 22 carbon atoms and a radical selected from the group consisting of sulfonic and sulfuric acid ester radicals. Such surfactants are well known in the detergent art. They are described at length in "Surface Active Agents and Detergents", Vol. II, by Schwartz, Perry & Berch, Interscience Publishers Inc., 1958, herein incorporated by reference.

Particularly suitable anionic surfactants for the instant invention are the higher alkyl mononuclear aromatic sulfonates. They contain from 10 to 16 carbon atoms in the alkyl chain. Alkali metal or ammonium salts of these sulfonates are suitable, although the sodium salts are preferred. Specific examples include: sodium linear tridecyl benzene sulfonate; sodium linear pentadecyl benzene sulfonate; and sodium p-n-dodecyl benzene sulfonate. These anionic surfactants are present usually from about 5% to about 30% by weight of the total composition. More preferably, they are present from about 15% to about 20%.

The compositions of this invention will contain detergent builders. Useful builders can include any of the conventional inorganic and organic water-soluble builder salts.

Typical of the well known inorganic builders are the sodium and potassium salts of the following: pyrophosphate, tripolyphosphate, orthophosphate, carbonate, bicarbonate, silicate, sesquicarbonate, borate and alumino silicate.

Among the organic detergent builders that can be used in the present invention are the sodium and potassium salts of citric acid and nitrilotriacetic acid. Particularly preferred among all the detergent builders are, however, the citric acid salts.

The detergent builders of this invention are generally used in a concentration range of from about 1% to about 30% by weight of the total formulation. Preferably, they are present from about 8% to about 15%.

The presence of a hydrotrope within the composition is highly desirable. Hydrotropes are substances that increase the solubility in water of another material which is only partially soluble. Preferred hydrotropes are the alkali metal or ammonium salts of benzene sulfonic acid, toluene sulfonic acid and xylene sulfonic acid. Hydrotropes are present from about 1% to about 10% by weight of the total composition.

Fatty ($C_{12}$–$C_{20}$) acids such as coconut fatty acids may be employed with the instant compositions as lather depressants. The fatty acids may be present from about 0.01% to about 1.0% by weight of the total composition.

Apart from the aforementioned cellulose ethers, surfactants, builders and hydrotropes, the compositions may contain all manner of minor additives commonly found in such liquid detergents and in amounts in which such additives are normally employed. Examples of these additives include: lather boosters, lather depressants, oxygen or chlorine-releasing bleaching agents, fabric softening agents, inorganic salts and buffering agents. Usually present in very minor amounts are fabric whitening agents, perfumes, enzymes, germicides, opacifiers and colorants.

STABILITY EVALUATION PROCEDURES

The procedure for evaluating freeze-thaw stability involves subjecting a sample in a glass jar to six controlled freeze-thaw cycles between 0° F. and 70° F. Typically, inspection of samples is performed after 1, 2 and 3 cycles but may be continued to a maximum of 6 cycles. Cycling time between 0° F. and 70° F. is 24 hours, except over weekends when temperature is maintained at 70° F. for 48 hours. Six hours are necessary for the temperature in the room to drop from 70° F. to 0° F. and 4 hours to rise from 0° F. to 70° F. These cycles are thought to simulate the most extreme conditions for storage and transportation of commercial products during winter months.

The major types of instability developing under freeze-thaw or low temperature storage range from sedimentation to gelation and finally solidification of cellulosics. Amount of cellulosic settling is measured by estimating the volume supernatant above the opaque cellulosics layer as a percent of total sample volume. This is referred to as the percent cellulosics "down". Jar contents are then poured out to evaluate the type of sedimentation and gelation.

The same procedure described above was also used for product stored at 35° F. and 25° F.

The following examples will more fully illustrate the embodiments of this invention. All parts, percentages and proportions referred to herein and in the appended claims are by weight unless otherwise indicated.

EXAMPLE 1

Evaluations of various cellulose ethers were performed within the base formulation described by Table I.

TABLE I

| Basic Composition | |
|---|---|
| Components | Weight % |
| Sodium linear alkylbenzene sulfonate | 17.0 |

TABLE I-continued

| Basic Composition | |
|---|---|
| Components | Weight % |
| Sodium citrate | 10.0 |
| Nonionic surfactant | 7.0 |
| Sodium xylene sulfonate | 5.0 |
| Monoethanolamine | 2.0 |
| Perfume | 0.15 |
| Stearic fatty acid | 0.075 |
| Fabric whitening agent | 0.069 |
| Opacifier | 0.05 |
| Colorant | 0.0083 |
| Cellulose Gum* | — |
| Water | to 100 |

*Amounts as per following examples.

A family of hydroxypropyl methylcellulose were evaluated for their stability in liquid detergent formulations. These cellulose ethers are characterized by a methoxyl content of 28–30%, hydroxypropyl content of 7–12%, methoxyl degree of substitution 1.78–2.03 and hydroxypropyl molar substitution of 0.18–0.34. The Dow Chemical Company supplies this family of cellulose ethers under the trademark Methocel E. Methocel E comes in various viscosity grades ranging from 50 cps for Methocel E-50 to Methocel E-100M of 100,000 cps viscosity.

Liquid detergents containing particular Methocel gums were incorporated into the formula of Table I. The formulation viscosity and freeze-thaw stability results are outlined in Table II. Although stability varied from excellent to fair, all the Methocel compositions in Table II were acceptable. Gum viscosities greater than 215 cps provided unacceptable product viscosities. Optimum viscosities were obtained with Methocel E-136 through Methocel E-169. All Methocel E gums listed in Table II were formulated at 0.5% by weight of the total liquid detergent.

TABLE II

| Viscosity-Stability Profile of Liquid Built Detergent With Various Methocel E Gums | | |
|---|---|---|
| Hydroxypropyl Methylcellulose | Liquid Detergent Viscosity (cps) | Stability After 3 Weeks at 0°–70° F. |
| Methocel E-50 | 80 | Good-Excellent |
| Methocel E-49 | — | Good-Excellent |
| Methocel E-52 | — | Good-Excellent |
| Methocel E-136 | 145 | Excellent |
| Methocel E-153 | 150 | Excellent |
| Methocel E-158 | 165 | Excellent |
| Methocel E-169 | 180 | Excellent |
| Methocel E-208 | 100 | Fair-Good |
| Methocel E-215 | 100 | Fair-Good |

EXAMPLE 2

A variety of other cellulose ether gums were evaluated. The liquid detergent composition of Table I, varied only by increasing sodium xylene sulfonate to 6%, served as the base formulation. Each cellulose ether outlined in Table III when incorporated into the base formulation resulted in a liquid detergent having cellulosic instability and viscosity change problems.

TABLE III

| Stability of Various Cellulose Ethers | | | | |
|---|---|---|---|---|
| Gum Trademark | Identity of Cellulose Ether | % Level in Detergent | Properties of Cellulose Ether | Stability After 3 Weeks at 0°–70° F. |
| Methocel A-15 | Methylcellulose | 0.45 | 27.5–31.5% methoxyl; 1.64–1.92 D.S. | POOR |
| Methocel A-15 | Methylcellulose | 0.9 | 27.5–31.5% methoxyl; 1.64–1.92 D.S. | POOR |
| Methocel F-50 | Hydroxypropyl Methylcellulose | 0.45 | 27–30% methoxyl; 4.0–7.5% hydroxypropyl; 0.10–0.20 hydroxypropyl MS; 1.67–1.94 methoxyl D.S. | POOR |
| Methocel K-35 | Hydroxypropyl Methylcellulose | 0.45 | 19–25% methoxyl; 4–12% hydroxypropyl; 0.10–0.33 hydroxypropyl MS; 1.12–1.64 methoxyl D.S. | POOR |
| Methocel K-100 | Hydroxypropyl Methylcellulose | 0.45 | 19–25% methoxyl; 4–12% hydroxypropyl; 0.10–0.33 hydroxypropyl MS; 1.12–1.64 methoxyl D.S. | POOR |
| Methocel HB-100 | Hydroxybutyl Methylcellulose | 0.45 | 31.0 min % methoxyl; 2.0 min % hydroxybutyl; 0.04 hydroxybutyl MS; 1.92 methoxyl D.S. | POOR |
| Methocel A-100 | Methylcellulose | 0.45 | 27.5–31.5% methoxyl; 1.64–1.92 D.S. | POOR |
| Tylose MH-50 | Methyl hydroxy ethyl cellulose | 0.45 | | FAIR |
| Tylose MH-300 | Methyl hydroxy ethyl cellulose | 0.25 | | POOR |
| CMC 3029 | Carboxymethyl cellulose | 0.45 | | POOR |

EXAMPLE 3

Soil-shield, anti-redeposition and detergency properties of liquid detergents containing Methocel E were comparable in performance to a control formulation containing methyl cellulose. While satisfactory in cleaning properties, the control formulation is unsatisfactory regarding stability during freeze-thaw cycles. Liquid detergents were formulated incorporating Methocel E at 0.45% into the liquid blend of Table I. Detergency results are recorded in Table IV.

TABLE IV

| Detergency of Methocel E-50 | | | | |
|---|---|---|---|---|
| | % Detergency at 100° F. | | | |
| Cellulose Gum | VCD | | LC | |
| Component | 60 ppm | 180 ppm | 60 ppm | 180 ppm |
| Methyl Cellulose (Control) | 41.7 | 26.2 | 51.9 | 43.9 |
| Methocel E-50 | 37.7 | — | 51.5 | 43.4 |
| Methocel E-136 | 41.2 | 24.6 | 53.1 | 43.2 |
| Methocel E-153 | — | 25.6 | 51.2 | 44.1 |
| Methocel E-158 | 40.5 | — | 51.7 | 43.0 |
| Methocel E-169 | 40.0 | 25.0 | 51.7 | 47.3 |

There is no significant difference in detergency between the control and any of the Methocel E containing formulations.

Detergency was evaluated by the Terg-o-tometer test method carried out in accordance with the conditions of temperature to water hardness recommended by ASTM-D12 Committee on Consumer Standards for Laundry Products. The wash loads employed standard soil swatches supplied by American Conditioning House (ACH), U.S. Testing Company, Test Fabric, Inc. One standard swatch was impregnated with vacuum cleaner dust (VCD). A second swatch was impregnated with clay (LC). Wash cycles consisted of a 10 minute wash at 90 rpm followed by a 1 minute rinse at 90 rpm in water of the same hardness as the detergency solution. Electric drying and ironing followed.

Soil-shield properties were evaluated for the same series of cellulose ethers. No significant differences were discerned between the control and Methocel E containing formulations with regard to soil-shield on 65/35 polyester/cotton fabric. Soil-shield properties were also achieved with Methocel E formulations on 100% polyester. However, the control performed better in these tests.

TABLE V

| Soil-Shield Properties of Methocel E Formulations | | | | |
|---|---|---|---|---|
| | % Soil Release | | | |
| Cellulose Gum | 180 ppm/120° F. | | 180 ppm/100° F. | |
| Component | 65/35 | Polyester | 65/35 | Polyester |
| Methyl Cellulose (Control) | 6.9 | 76.4 | 5.2 | 72.3 |
| Methocel E-50 | 6.7 | 73.3 | 4.4 | 52.5 |
| Methocel E-136 | 6.8 | 72.5 | 5.0 | 36.6 |
| Methocel E-153 | 6.9 | 71.8 | 5.1 | 46.7 |
| Methocel E-158 | 7.3 | 72.4 | 5.6 | 31.8 |
| Methocel E-169 | 7.1 | 72.5 | 4.7 | 31.8 |

Anti-redeposition properties were evaluated for Methocel E-136 incorporated at 0.5% into the formulation of Table I. Performance, as outlined in Table VI, was essentially identical between methylcellulose and Methocel E-136 compositions.

TABLE VI

| Anti-Redeposition Properties of Methocel E | | | | |
|---|---|---|---|---|
| | % Anti-Redeposition | | | |
| Cellulose Gum | 180 ppm/120° F. | | 180 ppm/100° F. | |
| Component | Cotton | Spun Dacron | Cotton | Spun Dacron |
| Methyl Cellulose (Control) | 81.5 | 84.7 | 83.9 | 84.3 |
| Methocel E-136 | 82.5 | 85.3 | 80.9 | 83.6 |

The foregoing description and examples illustrate selected embodiments of the present invention and in light thereof variations and modifications will be suggested to one skilled in the art, all of which are in the spirit and purview of this invention.

What is claimed is:

1. An aqueous liquid detergent composition for exhibiting good freeze thaw and low temperature storage stability comprising:

(i) from about 0.1% to about 1.5% hydroxypropyl methylcellulose having from 28 to 30% methoxyl and 7 to 12% hydroxypropyl substitution, the molecular weight ranging from 5 to 250 cps expressed as nominal viscosity of a 2% aqueous solution at 68° F.;

(ii) from about 0.1% to about 15% of a nonionic surfactant;

(iii) from about 5% to about 30% of an anionic surfactant; and (iv) from about 1% to about 30% of a builder.

2. A composition according to claim 1 wherein the hydroxypropyl methylcellulose has a nominal viscosity from about 112 to about 168 cps.

3. A composition according to claim 1 wherein the hydroxypropyl methylcellulose is present from about 0.2 to 0.8%.

4. A composition according to claim 1 wherein the nonionic surfactant is a $C_{12}$ to $C_{15}$ alcohol ethoxylated with from 5 to 50 moles ethylene oxide.

5. A composition according to claim 1 wherein the nonionic surfactant is present from about 2% to 10%.

6. A composition according to claim 1 wherein the anionic surfactant is an alkali metal or ammonium salt of a linear alkylbenzene sulfonate.

7. A composition according to claim 1 wherein the anionic surfactant is present from about 5 to 15%.

8. A composition according to claim 1 wherein the builder is sodium citrate.

9. A composition according to claim 1 further comprising from 1 to 10% of a hydrotrope.

10. A composition according to claim 1 wherein the hydrotrope is selected from sodium xylene sulfonate, sodium toluene sulfonate or mixtures thereof.

11. A composition according to claim 1 further comprising from about 0.01 to 1.0% of $C_{12}$–$C_{20}$ fatty acid.

* * * * *